United States Patent [19]

Freeman

[11] Patent Number: 4,836,279

[45] Date of Patent: Jun. 6, 1989

[54] NON-ROTATING PLUG

[75] Inventor: T. Austin Freeman, Duncan, Okla.

[73] Assignee: Halliburton Company, Duncan, Okla.

[21] Appl. No.: 272,608

[22] Filed: Nov. 16, 1988

[51] Int. Cl.[4] ..... E21B 17/14; E21B 33/16

[52] U.S. Cl. ..... 166/153; 166/155; 166/291; 166/317

[58] Field of Search ..... 166/153–156, 166/192, 179, 193, 194, 237, 202, 291, 285, 317

[56] References Cited

U.S. PATENT DOCUMENTS

| | | | |
|---|---|---|---|
| 2,165,433 | 7/1939 | Wickersham | 166/153 |
| 3,550,683 | 12/1970 | Comeaux | 166/156 |
| 3,581,817 | 6/1971 | Kammerer, Jr. | 166/285 X |
| 4,175,619 | 11/1979 | Davis | 166/153 X |
| 4,190,111 | 2/1980 | Davis | 166/153 X |
| 4,190,112 | 2/1980 | Davis | 166/153 X |
| 4,711,300 | 12/1987 | Wardlaw, III et al. | 166/153 |

*Primary Examiner*—Stephen J. Novosad
*Attorney, Agent, or Firm*—James R. Duzan

[57] ABSTRACT

The plug set of the present invention comprises an upper plug having a non-rotation insert retained therein and a lower plug having longitudinal splines therein and a non-rotation insert on the bottom thereof.

11 Claims, 2 Drawing Sheets

NON-ROTATING PLUG

BACKGROUND OF THE INVENTION

This invention is directed to an improved non-rotating plug set for use in cementing the casing in well bores.

Previously, a plug set and the residual cement in the casing cemented in a well bore were removed by drilling operations using tooth-type rock bits. The teeth on the rock bit proved effective in the drilling of the plug set, even though the individual plugs of the plug set were free to rotate with respect to each other and the floating equipment.

However, with the advent of polycrystalline diamond compact (PDC) drill bits to drill out the plug set and the residual cement in the casing cemented a well bore it has become necessary to use a non-rotating plug set during the well casing cementing process to facilitate the drilling of the plug set and residual cement. For whatever reasons, the cutters on the PDC drill bit do not as effectively drill through the conventional plug set used in casing cementing operations as the conventional tooth-type rock bit. However, with the use of a non-rotating plug set in casing cementing operations, the PDC drill bit can drill through the plug set, and residual cement and floating equipment in time periods comparable to that of conventional tooth-type rock bits.

BRIEF STATEMENT OF THE INVENTION

The present invention is directed to an improved non-rotating plug set for use in cementing the casing in well bores. The plug set of the present invention comprises an upper plug having a non-rotation insert retained therein and a lower plug having longitudinal splines and a non-rotation insert therein for use with standard or modified floating equipment.

The present invention will be better understood when the drawings of the present invention is taken in conjunction with the description of the invention hereafter.

DESCRIPTION OF THE INVENTION

Figure 1:
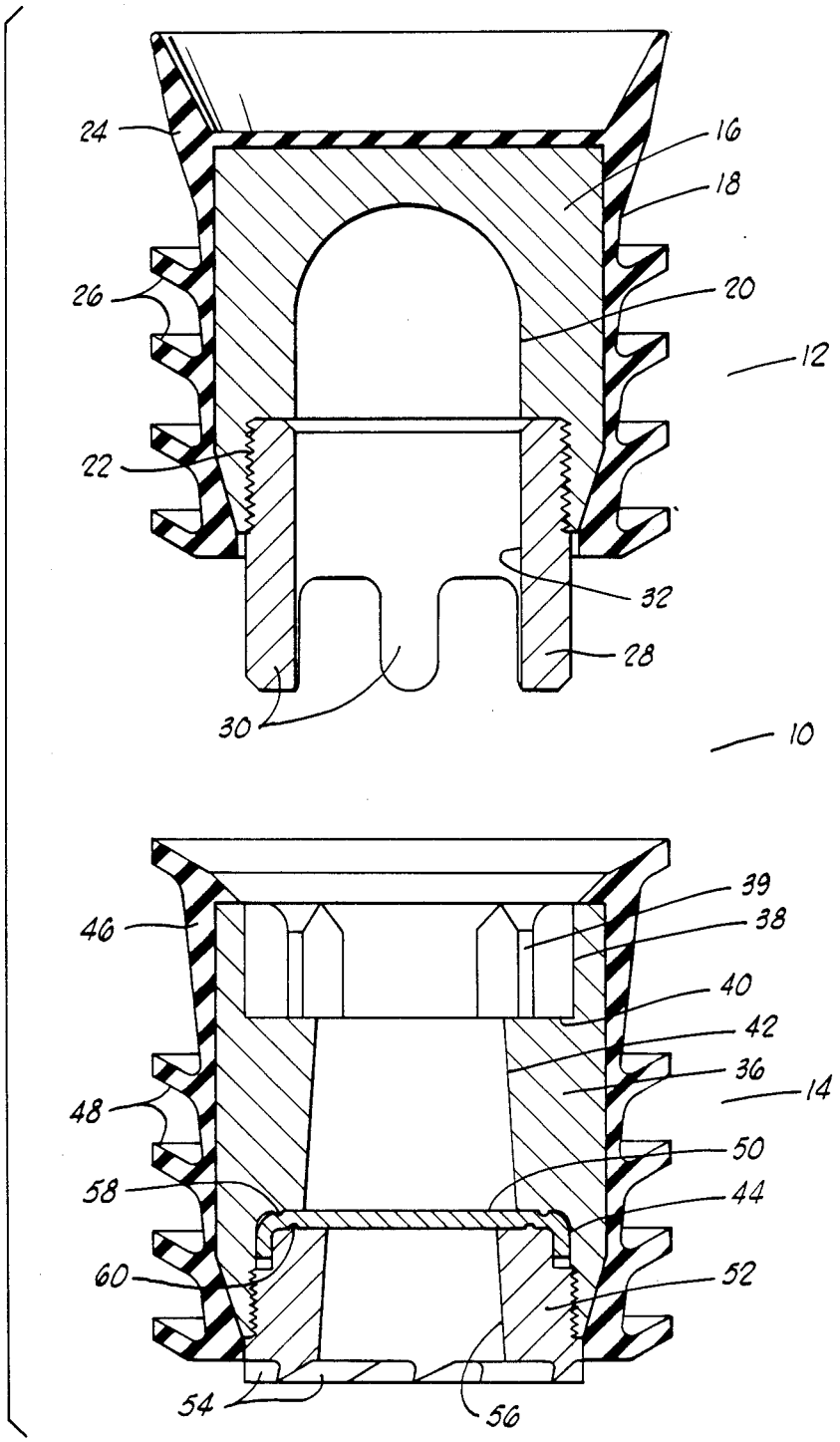
FIG. 1 is a cross-sectional view of the plug set of the present invention.

Referring to FIG. 1, the plug set 10 of the present invention is shown.

The plug set 10 of the present invention comprises an upper plug 12 and lower plug 14.

The upper plug 12 comprises a body member 16 having, in turn, a generally cylindrical exterior surface 18, first interior cavity 20 and second interior cavity 22, elastomeric wiper covering 24 having, in turn, a plurality of wipers 26 thereon, and annular anti-rotation insert 28 having, in turn, a plurality of enlongated projections 30 formed on one end thereof and bore 32 therethrough. The body member 16 may be formed of any suitable, easily drillable material, such as plastic, aluminum, etc. Similarly, the anti-rotation insert 28 may be formed of any suitable, easily drillable material, such as plastic, aluminum, etc. The anti-rotation insert 28 may be retained within the second cavity 22 of the body member 16 by any suitable means, such as adhesive bonding, threaded engagement, etc. The elongated projections 30 may be formed on the anti-rotation insert 28 by any suitable means, such as machining, molding, if the the insert 28 is molded plastic, etc.

The lower plug 14 comprises a body member 36 having, in turn, a generally cylindrical exterior surface and, on the interior, first bore 38 having, in turn, a plurality of longitudinal splines 39 thereon to receive elongated projections 30 of upper plug 12 therebetween shoulder 40, second bore 42 and third bore 44, elastomeric wiper covering 46 having, in turn, a plurality of wipers 48 thereon, elastomeric diaphragm 50 and annular bottom anti-rotation insert 52 having, in turn, teeth 54 on one end thereof and bore 56 therethrough.

As with the upper plug 12, the lower plug 14 may have the body member 36 formed of any suitable material, such as plastic, aluminum, etc. The annular bottom anti-rotation insert 52 may be formed of any suitable metal or plastic, such as aluminum, cast iron, etc. Similarly, lower anti-rotation insert 52 may be retained within the fourth bore 44 of the body member 36 by any suitable means, such as adhesive bonding, threaded engagement, etc. Also, the teeth 54 in the lower anti-rotation insert 53, may be formed thereon by any suitable means, such as machining, casting, molding, etc.

The elastomeric diaphragm 50 is retained within the body member 36 of the lower plug 14 by clamping the diaphragm 50 between the shoulder 58 of body member 36 and upper end 60 of the anti-rotation insert 52 with an annular ribs on the shoulder 58 and upper end 60 biting into the diaphgram 50.

Figure 2:
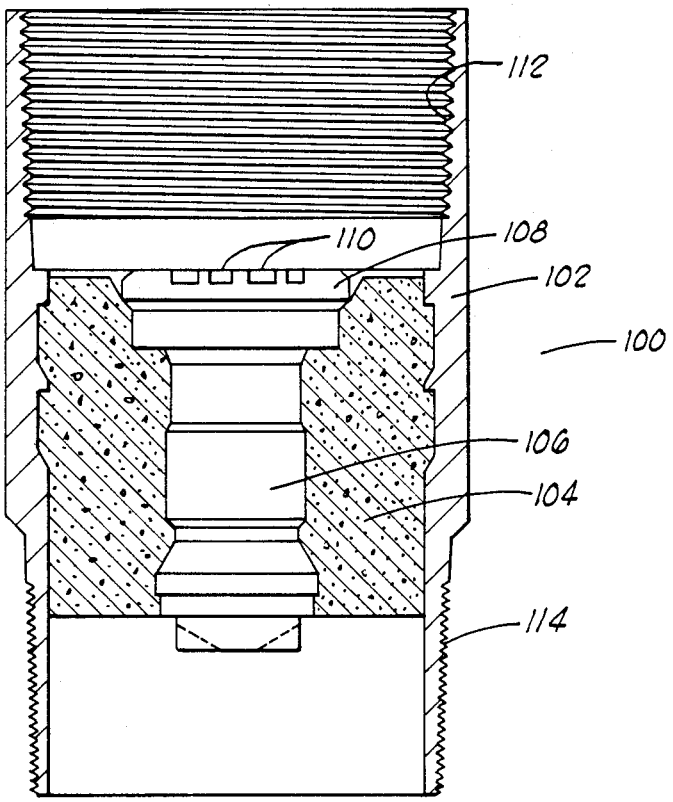
FIG. 2 is a cross-sectional view of a modified float collar for use with the present invention.

Referring to FIG. 2, a typical float collar 100 for use with the plug set 10 is shown. The float collar 100 comprising an annular housing 102, cementitious material 104, and float valve assembly 106 having anti-rotation insert member 108 thereon having, in turn, a plurality of recesses 110 therein.

It should be noted that the configuration of the elongated projections 30 of anti-rotation insert 28 of upper plug 12 and the longitudinal splines 39 of lower plug 14 geometrically match as well as the teeth 54 of lower anti-rotation insert 58 of lower plug 14 and the teeth 110 of insert member 108 of float collar 100.

Additionally, it should be appreciated that although a float collar 100 has been shown, any suitable piece of floating equipment, such as a float shoe assembly, may be used with the plug set 10 whether or not the floating equipment includes an anti-rotation insert 108 to engage the lower anti-rotation insert 52 of the lower plug 14.

OPERATION OF THE INVENTION

Referring to FIG. 1, a float collar or float shoe (not shown) is assembled into a string of casing (not shown) to be connected into a well bore.

When it is desired to cement the string of casing having the float collar or float shoe therein in the well bore, the lower plug 14 of the plug set 10 is pumped through the casing by cement until it lands on the cementitious material and float valve assembly of the float collar or float shoe with the teeth 54 of the anti-rotation insert 52 engaging the float collar. As the lower plug 24 is pumped through the casing, the outer wiper covering 46 wipes drilling fluid from the interior of the casing string.

After the lower plug 14 has landed on the float collar or float shoe, the pressure of the cement being pumped behind the lower plug 14 is increased until the pressure ruptures the elastomeric diaphragm 50 of the lower plug 14 allowing cement to be pumped therethrough.

After the desired amount of cement has been pumped through the casing, lower plug 14 and float collar 100, the upper plug 12 is pumped through the casing having the elastomeric wiper covering 24 thereon wiping cement from the casing until the upper plug 12 lands on the lower plug 14 having the elongated projections 30 of the anti-rotation insert 28 of the upper plug 12 engaging the longitudinal splines 39 of first bore 38 of the body member 36 of the lower plug 14.

After a suitable waiting period for the cement to set, a drill bit is then lowered through the casing to drill out the upper plug 12, lower plug 14, residual cementitious material and float collar assembly.

It will be appreciated that since the elongated projections 30 of anti-rotation insert 28 of upper plug 12 engage the longitudinal splines 39 of first bore 38 of body member 36 of lower plug 14 and the teeth 54 of anti-rotation insert 52 of plug 14 engage float collar or float shoe, rotation of the plug set 10 is minimized during the drilling process thereby reducing the amount of drilling time required.

Having thus described my invention, I claim:

1. An anti-rotation plug set comprising:

an upper plug including:

a body member having a cavity in the bottom thereof;

an elastomeric wiper covering disposed about a portion of the body member and retained thereon; and an anti-rotation insert retained within the cavity in the bottom of the body member, the insert having a plurality of downwardly facing elongated projections thereon; and a bottom plug including:

a body member having a bore therethrough having, in turn, a plurality of longitudinal recesses in the upper portion thereof adapted to receive the downwardly facing elongated projections of the upper plug;

an elastomeric wiper covering disposed about a portion of the body member and retained thereon;

an diaphragm sealing the bore through the body member, the diaphragm located below the longitudinal recesses in the upper portion of the bore in the body member; and a anti-rotation insert retained within the lower portion, the bore through the body member, the lower anti-rotation insert having a plurality of downwardly facing teeth thereon.

2. The combination of claim 1 wherein:

the body member of the upper plug and the anti-rotation insert are formed of plastic.

3. The combination of claim 1 wherein:

the body member of the lower plug and the anti-rotation insert are formed of plastic.

4. The combination of claim 1 wherein:

the body member of the upper plug and the anti-rotation insert are formed of aluminum.

5. The combination of claim 1 wherein:

the body member of the lower plug, and the anti-rotation insert are formed of aluminum.

6. The combination of claim 1 wherein:

the anti-rotation insert of the upper plug and the anti-rotation insert of the lower plug are adhesively bonded to the respective body member of the upper plug and body member of the lower plug.

7. The combination of claim 1 wherein:

the anti-rotation insert of the upper plug and the lower anti-rotation insert of the lower plug are threadedly engaged with the respective body member of the upper plug and body member of the lower plug.

8. The combination of claim 1 further comprising:

a piece of floating equipment having a portion thereof adapted to engage the downwardly facing teeth on the anti-rotation insert of the lower plug of said anti-rotation plug set.

9. The combination of claim 8 wherein:

the piece of floating equipment having a plurality of upwardly facing teeth therein to engage the downwardly facing teeth of the anti-rotation insert of the lower plug of said anti-rotation plug set.

* * * * *

UNITED STATES PATENT AND TRADEMARK OFFICE

CERTIFICATE OF CORRECTION

PATENT NO. : 4,836,279

DATED : June 6, 1989

INVENTOR(S) : T. Austin Freeman

It is certified that error appears in the above-identified patent and that said Letters Patent is hereby corrected as shown below:

In column 2, line 60, delete the numeral [24] and insert therefore --14--.

Signed and Sealed this

Third Day of April, 1990

*Attest:*

HARRY F. MANBECK, JR.

*Attesting Officer*

*Commissioner of Patents and Trademarks*